United States Patent [19]

Kubik et al.

[11] Patent Number: 4,974,480

[45] Date of Patent: Dec. 4, 1990

[54] SPRING TENSIONING DEVICE

[76] Inventors: Anthony W. Kubik, 117 Weiters St.; Christopher M. Horsley, 525 Recold Rd., both of Walterboro, S.C. 29488

[21] Appl. No.: 381,180

[22] Filed: Jul. 17, 1989

[51] Int. Cl.[5] ..... B25B 33/00

[52] U.S. Cl. ..... 81/488

[58] Field of Search ..... 81/488, 13, 55, 185, 81/436, DIG. 11; 29/240

[56] References Cited

U.S. PATENT DOCUMENTS 2,305,274 12/1942 Power ..... 81/13

3,875,829 4/1975 Evans et al. ..... 81/185

*Primary Examiner*—Roscoe V. Parker

[57] ABSTRACT

A device used to wind the recoil starter spring of a small engine and hold the spring in a wound position while the maintenance person installs a new starter system pull rope.

1 Claim, 1 Drawing Sheet

SPRING TENSIONING DEVICE

SUMMARY OF INVENTION

The spring tensioning device is a device which will aid in the process of starter rope replacement on a Briggs and Stratton small engine by supplying the maintenance person with a method of easy spring winding and retention while the starter rope itself is fed into the engine shroud and the recoil system therein. The spring tensioning device has a basic two piece design consisting of a specially designed spring driver and a retention rod. With the engine cooling shroud removed, the spring driver is inserted into the recoil system mounted on the engine shroud and driven with a socket or other suitable device to wind the spring of the recoil system. Once the spring is wound, the retension rod is inserted through the ribs of the recoil system mounted on the engine shroud and threaded into one of the four holes provided in the spring driver. The pressure of the retention rod against a recoil system mounting rib will hold the spring securely and safely in a wound position while the starter rope is inserted into the recoil system from the outside of the shroud.

BRIEF DESCRIPTION OF THE DRAWINGS

FIG. 2 also shows a view of the plain cylindrically shaped retention rod with a diameter same as the nominal size of the threads. The rod is knurled on the opposite end of the threads to provide for slip free operation as the rod is threaded into the spring driver when the spring is wound.

DETAILED DESCRIPTION

Figure 1:
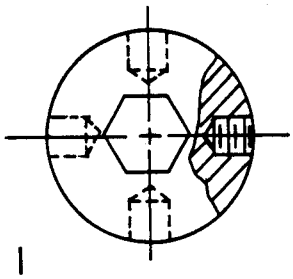
FIG. 1 of the drawing shows a top view of the spring driver with its hexagonal head. This hexagonal head, to be driven by the wrench or socket, is located atop a larger intermediate cylindrical portion provided with 4 threaded holes spaced equidistant around the periphery to accommodate the threaded portion of the retention rod. (Part 2 of FIG. 2).
Figure 2:
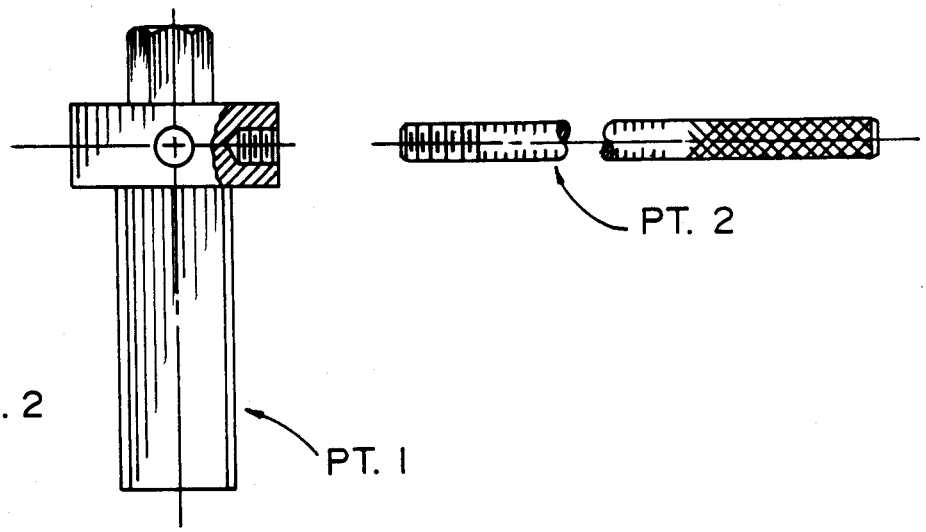
FIG. 2 is a front view of the spring driver showing the square lower portion which is inserted into the matching internal configuration of the starter recoil system attached to the recoil spring.
Figure 3:
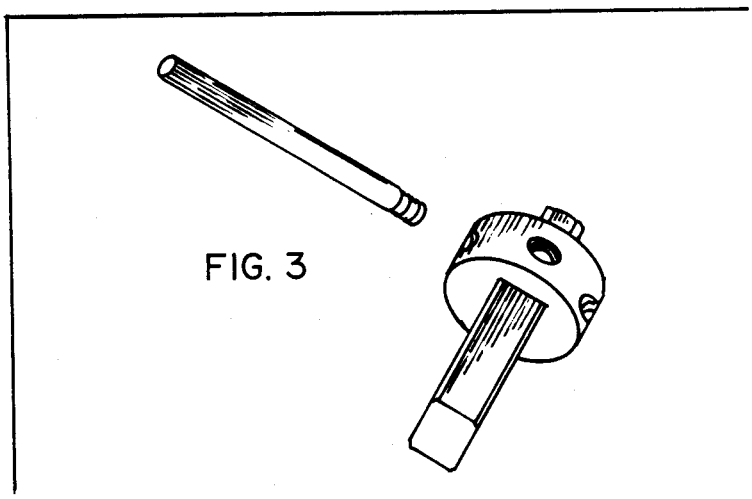
FIG. 3 of the drawing is an isometric view of the Spring Tensioning Device.

The hexagonal head of the spring driver shall be of a standard size so that no special wrench is required to rotate it. A size of ½" flat to flat should be sufficient with appropriate clearance for a standard ½" wrench or socket to engage with it without binding. The depth of the hexagon shall be sufficient so that the wrench or socket is not likely to slip from it. Once again, approximately ½" should be sufficient.

The intermediate cylindrical portion below the hexagonal head shall be of sufficient diameter so that 4 drilled and tapped holes 1/4-20 UNC by ⅜" deep can be placed at locations 90 degrees apart around the periphery. A diameter of approximately 1¼" and a length of approximately ½" should be sufficient to provide the strength required.

The square portion of the spring driver is of ¾" width measured flat to flat with champhers on the corners to match the internal drive configuration of the recoil system. The length of the square shall be of sufficient to provide positive drive without slipping. A length of approximately 1¼" should be sufficient.

The retention rod consists of a ¼" diameter rod with one end threaded to match the drilled and tapped holes of the spring driver, and the other end knurled to provide for good finger traction. Once the spring has been wound to sufficient tension using the spring driver and wrench or socket, the retention rod is inserted through any convenient opening between the mounting ribs of the recoil system and threaded into the nearest of the four drilled and tapped holes. The rod length need only be that required to reach the recoil system ribs from the center. A length of 5" is sufficient.

Once the spring is held in the wound position by spring tension of the retention rod against a recoil system mounting rib, both hands of the maintenance person can be used to feed the new starter rope into the recoil system from the outside and attach it to the mechanism inside.

What is claimed is:

1. A one piece spring tensioning device terminating in two ends, one end including a hexagon for a wrench or socket, and a square on the opposite end for driving a recoil system, between the two ends, an intermediate cylindrical flange member, said flange member having 4 spaced holes around the circumference thereof, said holes 90 degrees apart each, designed to receive a retention rod.

* * * * *